US007291226B2

(12) United States Patent
Laurer et al.

(10) Patent No.: US 7,291,226 B2
(45) Date of Patent: Nov. 6, 2007

(54) PROGRESSIVE STENCIL PRINTING

(75) Inventors: Jonathan H. Laurer, Lexington, KY (US); Jeanne M. Saldanha Singh, Lexington, KY (US); Paul T. Spivey, Lexington, KY (US); Mary C. Smoot, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 30 days.

(21) Appl. No.: 10/956,938

(22) Filed: Sep. 30, 2004

(65) Prior Publication Data

US 2006/0068111 A1 Mar. 30, 2006

(51) Int. Cl.
*B05C 17/06* (2006.01)
*B05D 1/32* (2006.01)

(52) U.S. Cl. ..... 118/301; 118/406; 118/712; 118/504; 118/505; 29/890.1; 156/578; 101/122

(58) Field of Classification Search ..... 118/301, 118/406, 712, 504, 505; 101/122, 127–129; 29/25.35, 890.1, 35.5; 228/215, 39, 22, 23; 156/578; 347/64, 65, 203; 427/282
See application file for complete search history.

(56) References Cited

U.S. PATENT DOCUMENTS 801,557 A 10/1958 McCormick
4,604,966 A 8/1986 Kohn
4,680,859 A 7/1987 Johnson
4,771,687 A * 9/1988 Daunheimer ..... 101/44
5,130,755 A 7/1992 Ikegawa et al.
5,395,643 A * 3/1995 Brown et al. ..... 427/98.4
5,436,028 A 7/1995 Becher et al.
5,452,656 A 9/1995 Becher et al.
5,478,700 A 12/1995 Gaynes et al.
5,627,108 A 5/1997 Alibocus et al.
5,669,970 A 9/1997 Balog et al.
5,807,606 A 9/1998 Mould et al.
5,938,106 A * 8/1999 Pierson ..... 228/246
5,950,309 A * 9/1999 Bryce et al. ..... 29/890.1
5,953,032 A 9/1999 Haarz et al.
6,036,787 A 3/2000 Bennett et al.
6,098,257 A * 8/2000 Koido et al. ..... 329/25.35
6,201,940 B1 3/2001 Lee
6,367,378 B1 4/2002 Yamazaki (Continued)

FOREIGN PATENT DOCUMENTS

EP 0 867 293 9/1998

(Continued)

OTHER PUBLICATIONS

Terry Base, Walt Beltz, Terry Rose, Mary Smoot, Cary Williams, Ross Berntson, Kelvin Ho, David Sbirol, "Eliminating Solder Beads in No-Clean PCB's," Circuits Assembly, American Society of Business Publication Editors (U.S.A.), (Jul. 2001).

*Primary Examiner*—Laura Edwards
(74) *Attorney, Agent, or Firm*—Thompson & Hine

(57) ABSTRACT

A progressive stencil printing system and method for applying encapsulant onto an inkjet printhead body is described. The system relates to a continuous stencil printing apparatus that can print encapsulant on different types of inkjet printhead bodies and clean the stencil during production.

11 Claims, 3 Drawing Sheets

U.S. PATENT DOCUMENTS

| | | | |
|---|---|---|---|
| 6,380,511 | B1 | 4/2002 | Santhanam |
| 6,495,199 | B1 | 12/2002 | Kaiser et al. |
| 6,527,041 | B1 | 3/2003 | Farnworth |
| 6,530,519 | B1 | 3/2003 | Suzuki |
| 6,626,106 | B2 | 9/2003 | Peckham et al. |
| 2002/0020346 | A1 | 2/2002 | Doyle et al. |
| 2002/0108513 | A1 | 8/2002 | Onishi et al. |
| 2003/0037804 | A1 | 2/2003 | Erdmann |
| 2003/0097941 | A1 | 5/2003 | Rossmeisl et al. |
| 2004/0089171 | A1 | 5/2004 | Jiang et al. |

FOREIGN PATENT DOCUMENTS

| | | |
|---|---|---|
| EP | 0 888 891 | 1/1999 |

* cited by examiner

PROGRESSIVE STENCIL PRINTING

FIELD OF THE INVENTION

The present invention relates generally to an apparatus and method for applying encapsulant adhesive to inkjet printhead bodies and, more particularly, to a progressive stencil printing apparatus which applies encapsulant adhesive to inkjet printhead bodies in a substantially continuous mode.

BACKGROUND OF THE INVENTION

Drop-on-demand ink jet printers use thermal energy to produce a vapor bubble in an ink-filled chamber to expel a droplet. A thermal energy generator or heating element, usually a resistor, is located in the chamber on a heater chip near a discharge orifice. A plurality of chambers, each provided with a single heating element, are provided in the printer's printhead. The printhead typically comprises the heater chip and a nozzle plate having a plurality of the discharge orifices formed therein. The printhead forms part of an ink jet print cartridge, which also comprises an ink-filled container.

The resistors are individually addressed with an energy pulse to momentarily vaporize the ink and form a bubble that expels an ink droplet. A flexible circuit is used to provide a path for energy pulses to travel from a printer energy supply circuit to the printhead. The flexible circuit includes a substrate portion and a plurality of traces located on the substrate portion. The traces have end sections that extend out from the substrate portion. The extending sections are coupled to bond pads on the printhead. Typically, there is a first row of coupled bond pads and trace sections and an opposing, second row of coupled bond pads and trace sections.

It is known in the art to form a barrier layer over each row of coupled bond pads and extending trace sections. One known process for forming such a barrier layer involves dispensing an encapsulant material onto the coupled bond pads and trace sections using a discharge needle. The final height of the barrier layer relative to the nozzle plate typically is undesirably high. As a result, a paper substrate, which receives the ejected ink droplets, is spaced an increased distance from the printhead orifice plate. Consequently, misdirected ink droplets reach the paper substrate at locations which are spaced a greater distance from their intended contact points than if the paper substrate were located closer to the printhead orifice plate. The excessive height of the barrier layer is further problematic as it makes it more difficult to apply a length of sealing tape to the printhead so as to seal the printhead orifices from ink leakage until the print cartridge is installed for use in a printer. Another potential problem associated with dispensing an encapsulant material with a discharge needle relates to improper location. Dispensing encapsulant in the wrong locations can result in unacceptable product because the encapsulant fails to provide the necessary coverage for the electrical components on the print cartridge.

One method for providing encapsulant on an inkjet printhead that addresses some of the problems associated with needle dispensing utilizes stencil printing to apply the encapsulant. Commonly assigned U.S. patent application Ser. No. 10/679,070 describes a method of stencil printing an encapsulant material over electrical connections and other areas on an inkjet printhead. Typical stencil printing operations are considered discontinuous in that a single stencil is used to apply encapsulant to a number of components. The component to be stencil printed is positioned in the stencil printer under a stencil, the stencil and part to be printed are brought into contact and an encapsulant is deposited on the stencil and squeezed through the holes of the stencil by a squeegee which is moved across the upper face of the stencil. When the printing is complete, the stencil is lifted off the substrate and the substrate is removed so that the process can be repeated with additional substrates. Because this process is discontinuous, it is slow, time consuming and, therefore, relatively expensive.

The conventional stencil printing process can also involve a build up of excess encapsulant in or around the holes of the stencil, that can impede flow of the encapsulant to the substrate. Furthermore, encapsulant may also build up on the underside of the stencil adjacent to the holes. In either case, the build up of excess adhesive on the stencil can lead to poor quality printheads. As the requirement for inkjet printhead print quality increases, the need for a clean stencil surface also increases so that the inkjet printhead nozzles are kept free of excess encapsulant. Options available for keeping the stencil clean are limited. Operators may resort to manually wiping the excess encapsulant from the stencil. However, this may not be sufficient to dislodge encapsulant gathered in the holes of the stencil. Furthermore, manual removal of excessive encapsulant is labor and time intensive and not always reliable. In a conventional stencil printing process, the buildup of material on the underside of the stencil requires a separate wiping process. This underside wiping step increases the process cycle time and effectively makes the conventional stencil printing process discontinuous.

Therefore, it would be desirable to provide a method of cleaning excessive encapsulant from the stencil that can be included as part of a continuous operation. Furthermore, it would be desirable to provide a stencil printing method capable of applying encapsulant to a variety of printhead designs as part of a continuous printing operation.

SUMMARY OF THE INVENTION

The present invention relates to a progressive stencil printing system for applying encapsulant onto an inkjet printhead body. The system includes a roll of film with one or more stencil patterns that correspond to patterns of encapsulant adhesive to be applied onto one or more inkjet printhead bodies. The stencil is provided as a roll of film coupled to a first drive device that moves the film along a given path. The system further includes an encapsulant dispensing device for applying encapsulant to a printhead body through the stencil pattern. The encapsulant-dispensing device applies encapsulant through a first stencil onto a first printhead body and through subsequent stencils onto additional printhead bodies. The various stencil patterns can be the same or different depending on the inkjet printhead bodies to which the encapsulant is to be applied.

In accordance with particular embodiments of the invention, the stencil printing system further includes a cleaning device positioned downstream of the encapsulant dispensing device for removing residual encapsulant from the stencil film. The cleaning device in one aspect of the invention includes a cleaning blade that contacts the film at an angle to remove residual encapsulant from the film.

The stencil printing system may also include one or more optical sensors. The optical sensors may be set up to detect features on the stencil indicative of various parameters such as location, timing, identity, etc. The stencil printing system may also include mechanisms for identifying the particular type of printhead body to be printed and positioning the corresponding stencil pattern into place on the stencil printer. Identification of the printhead type can be as simple as visual identification by the stencil printer operator or as complicated as automated machine recognition of the printhead and automatic alignment of the appropriate stencil pattern.

The stencil printing system may also be configured to include a cleaning bath containing solvent disposed downstream of the encapsulant dispensing device for removing residual encapsulant from the stencil. In accordance with particular embodiments, an ultrasonic solvent bath may be used. In accordance with certain embodiments of the present invention, the stencil printing system may also include methods to wipe and/or dry the stencil after stencil printing and cleaning.

In accordance with another aspect of the invention, a method for applying encapsulant onto an inkjet printhead body is disclosed. The method in accordance with this aspect of the invention includes the steps of providing a roll of film with one or more stencil patterns, aligning each stencil pattern with a corresponding printhead body, dispensing encapsulant to the printhead body through the stencil pattern, indexing the roll of film to align the next stencil pattern with another printhead body, and dispensing encapsulant to the next printhead body.

BRIEF DESCRIPTION OF THE DRAWINGS

Further advantages of the invention will become apparent by reference to the detailed description when considered in conjunction with the figures, which are not to scale, wherein like reference numbers indicate like elements through the several views, and wherein.

DETAILED DESCRIPTION OF THE INVENTION

All documents cited are, in relevant part, incorporated herein by reference; the citation of any document is not to be construed as an admission that it is prior art with respect to the present invention.

The present invention will be described in more detail with reference to a stencil printing system for stencil printing an encapsulant onto an inkjet printhead. One of skill in the art will realize that the invention is equally applicable to screen printing. Accordingly, the terms stencil and screen may be used interchangeably herein to describe a device in a printer that defines a pattern to be printed on a substrate.

Figure 1:
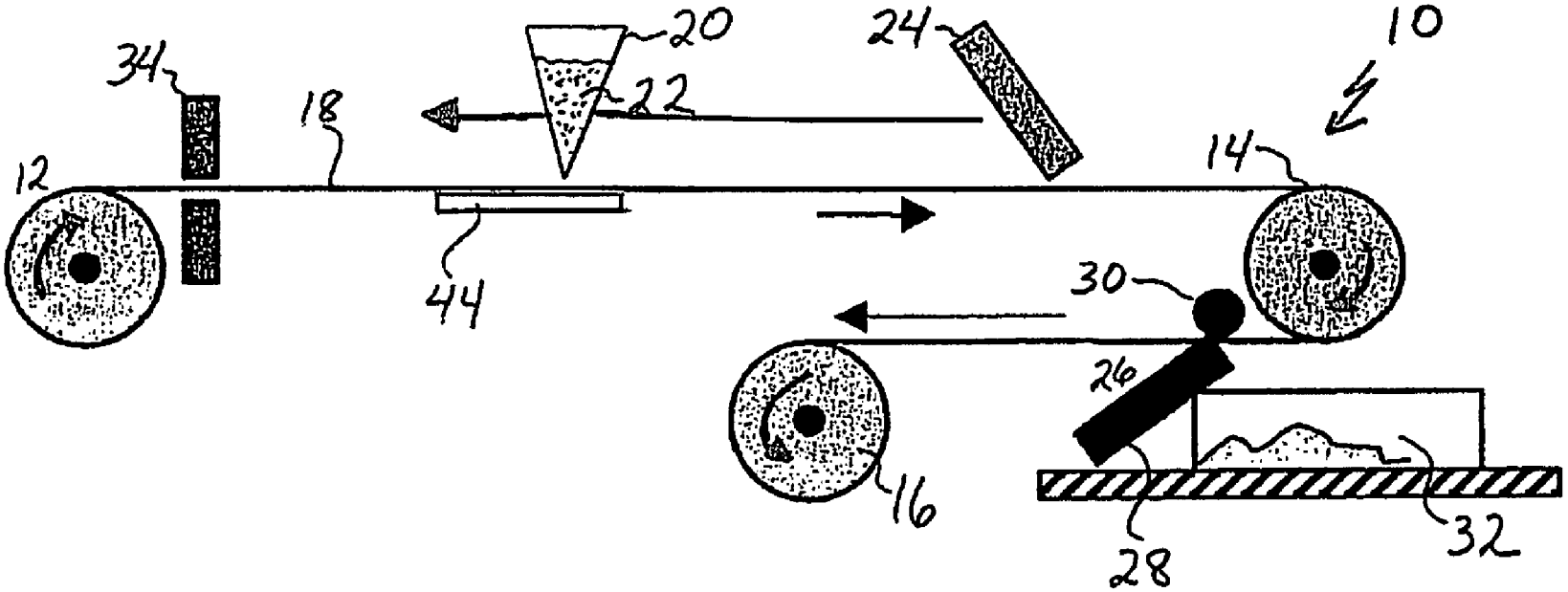
FIG. 1 is a diagrammatic view of a progressive stencil printing system in accordance with one aspect of the invention.

Turning now to the drawings, and referring initially to FIG. 1, a progressive stencil printing system in accordance with one embodiment of the present invention is illustrated and generally designated by the reference numeral 10. It will be appreciated that the stencil printing system 10 is illustrated in diagrammatic form in order to explain its operation in an easily understandable manner. However, in actual practice, the shape and size of the system 10 might be substantially different from that illustrated and yet still be within the scope of the claims set forth herein.

The stencil printing system 10 includes a stencil unwind 12, an intermediate roller 14 and a stencil rewind 16, wherein a stencil film 18, in the form of a substantially continuous web, rolled around the stencil unwind 12 is unrolled and is conveyed along a path around intermediate roller 14 to be rewound on stencil rewind 16.

An encapsulant dispensing device 20 is disposed downstream of the stencil unwind 12 with respect to the direction in which the stencil 18 is conveyed. The encapsulant-dispensing device 20 contains a quantity of encapsulant 22. Disposed downstream of the encapsulant dispensing device 20 is a squeegee 24 which travels in a direction opposite that of the stencil film 18. The encapsulant dispensing device 20 and squeegee 24 can be provided as a single device, which dispenses encapsulant and rolls the encapsulant over the stencil 18. Furthermore, the squeegee 24 can move in either direction. There are some advantages to having the squeegee 24 move in one direction, such as reduced air entrapment as compared to back and forth wiping. The single wipe direction also improves stencil print consistency as the fill and transfer of encapsulant through the stencil will always be in the same direction in accordance with this aspect of the present invention.

A cleaning device 26 may be positioned downstream of the intermediate roller 14 or at any location after stencil printing the encapsulant. Cleaning device 26 as shown in FIG. 1 includes a cleaning blade 28, a cleaning back-up roller 30 and a waste box 32. The cleaning blade 28 and cleaning back-up roller 30 are positioned on opposite sides of the stencil film 18 and form a nip therebetween allowing passage of the stencil film 18. The cleaning blade 28 in the embodiment illustrated in FIG. 1 contacts the stencil film 18 at an angle and makes sufficient contact with the film 18 to remove residual encapsulant.

The stencil printing system 10 illustrated in FIG. 1 also includes an optical sensor 34 which can be used to index the roll and verify the position and progress of stencil film 18 in the system. The optical sensor 34 can be configured to detect various features on the stencil, which can correspond to the location, timing, identity, etc. of the stencil film 18 in the stencil printing system 10.

Figure 2:
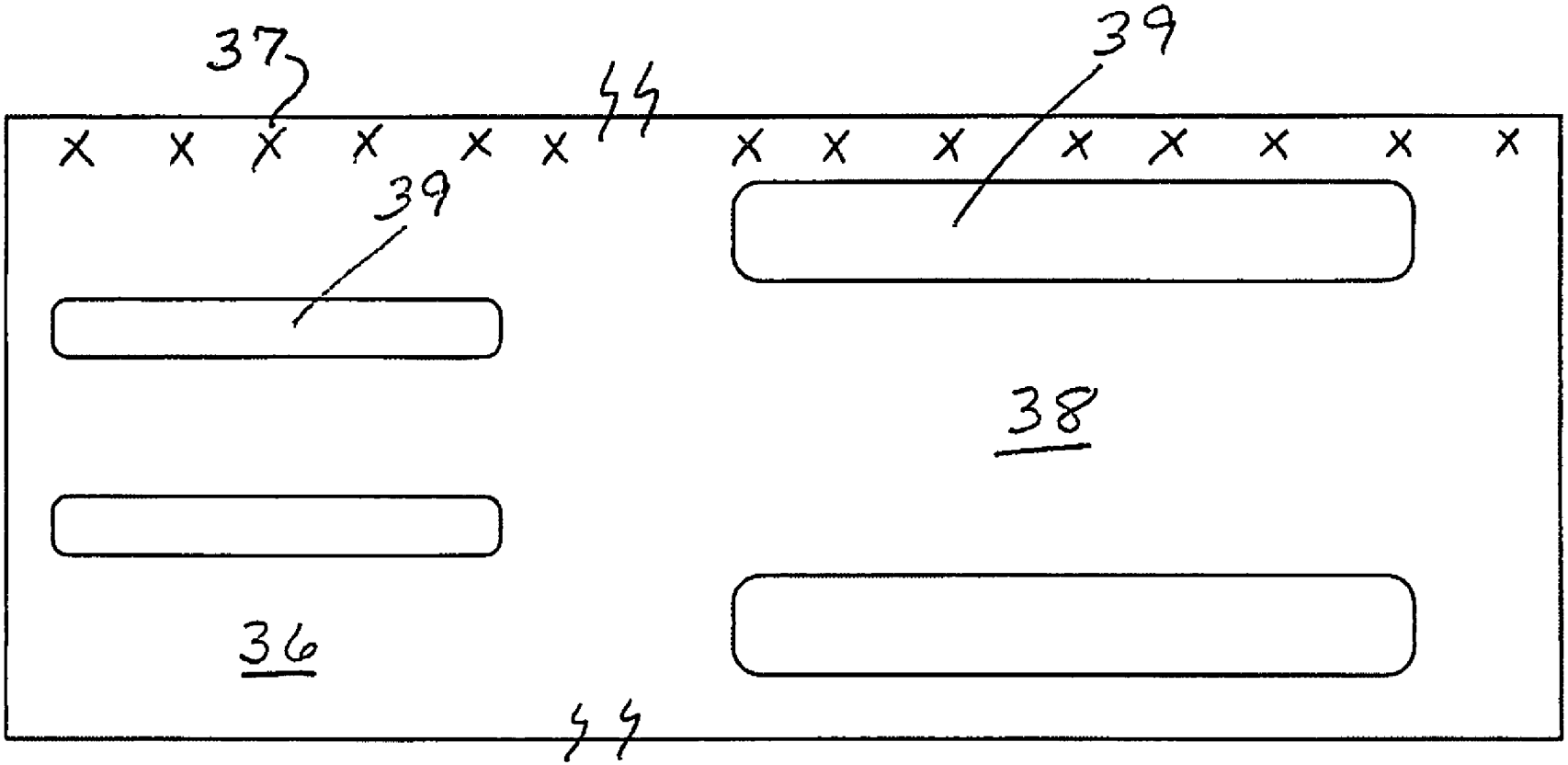
FIG. 2 is a top view of a portion of a stencil film in accordance with one aspect of the invention.

As seen in FIG. 2, the stencil film 18 includes a plurality of stencil patterns 36, 38 which may be the same or different. The stencil film 18 depicted in FIG. 2 includes a first stencil pattern 36 and a second stencil pattern 38 wherein each stencil pattern includes openings 39 corresponding to a pattern of encapsulant adhesive to be applied onto inkjet printhead bodies of different types. In other words, the first stencil pattern 34 corresponds to an encapsulant adhesive pattern for a first inkjet printhead and the second stencil pattern 38 corresponds to a pattern of an encapsulant adhesive for a second inkjet printhead. Accordingly, the stencil printing system 10 provides a method for printing encapsulant adhesive on multiple inkjet printhead bodies while eliminating downtime or changeover time associated with switching out stencils in a conventional stencil printing process. Of course, the invention is not limited to only two different stencil patterns or printhead body types. The number of different stencil patterns and body types that can be used is only limited by the space available on the stencil film 18. As indicated in FIG. 2, an break in the stencil film is shown to indicate that the actual space between any two stencil patterns can vary significantly as required by the particular application. The stencil patterns should not be so close as to interfere with adhesive application.

Figure 3:
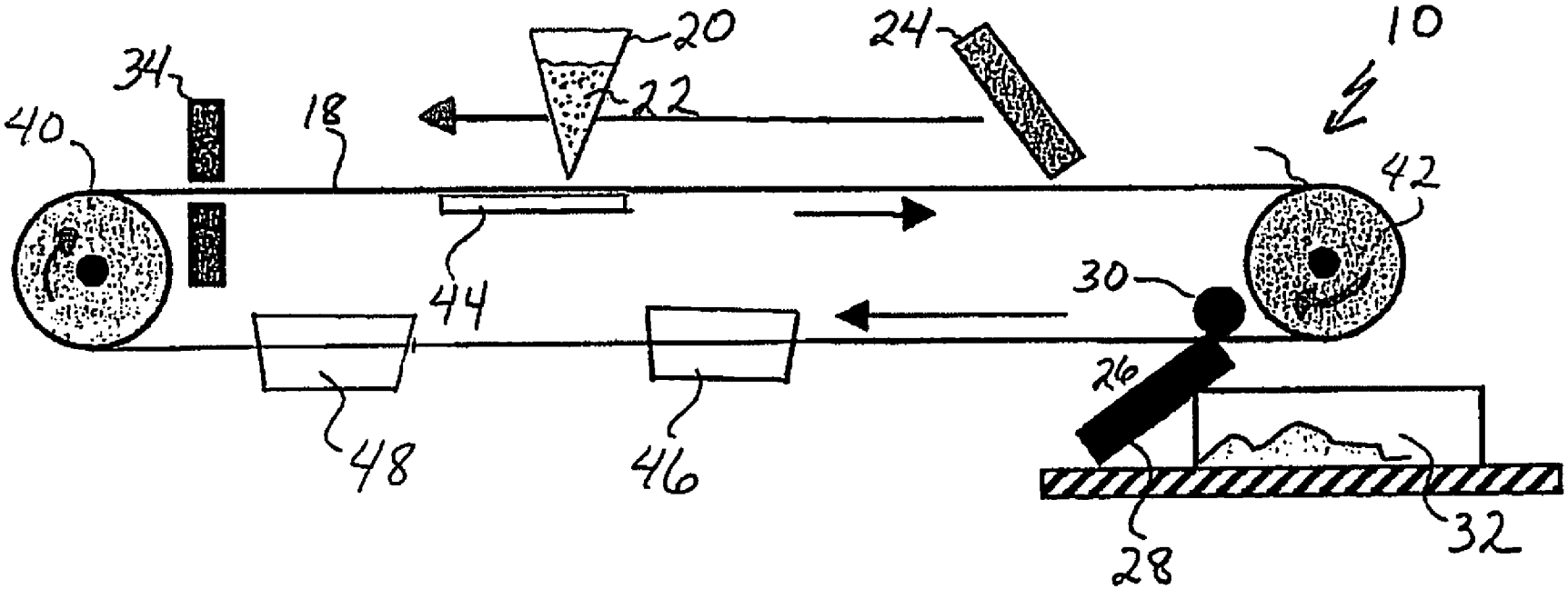
FIG. 3 is a diagrammatic view of a progressive stencil printing system in accordance with another aspect of the invention.

FIG. 3 illustrates another embodiment of the present invention wherein the stencil film 18 is provided as a continuous loop around first and second rollers 40 and 42. This embodiment further discloses the use of a cleaning bath 46 disposed downstream of the cleaning device 26. In accordance with particular embodiments of the present invention, the cleaning bath 46 will contain a solvent capable of removing residual encapsulant from the stencil film. Furthermore, the cleaning bath 46 may be an ultrasound-cleaning bath to improve cleaning of the stencil film 18.

Operation of the system will be described by reference to FIG. 1. The initial step in this process is the collection of a printhead body 44 which may be performed by automated equipment at the direction of a control unit such as a computer. Once the inkjet printhead 44 has been collected, it is identified either by the human operator or by automated equipment. The inkjet printhead 44 may be imaged by a camera or other image capture device or scanned by a scanner or other device for identifying the inkjet printhead. Various features on the inkjet printhead 44 may be used to identify it such as fiducials, shape, coded information, etc. as compared to previously collected information. The inkjet printhead 44 could be provided with a bar code or other identification code, which could be scanned to automatically identify the type of printhead.

Once the type of inkjet printhead 44 is determined, the inkjet printhead body 44 is aligned beneath the stencil film 18. The appropriate stencil pattern 36 or 38 corresponding to the type of inkjet printhead body 44 is indexed to a position in alignment with the inkjet printhead body 44. The inkjet printhead body 44 and aligned stencil pattern are brought into contact such that the areas of the inkjet printhead body 44 to receive encapsulant are aligned with the openings 39 in the stencil film 18. In accordance with certain embodiments of the present invention, various methods may be employed to keep the stencil film 18 taut to maintain alignment with the inkjet printhead body 44 during the printing process. Examples of these methods include, but are not limited to, the use of tapered or crowned rollers that provide tension over the openings 39, the use of a sprocketed stencil and one or more corresponding sprocketed wheels that can provide controlled tension and application of tension on the stencil film 18 by raising the printhead body 44 sufficiently above the plane of the stencil film 18 to produce tension in the region of the openings 39.

Encapsulant 22 is dispensed from the encapsulant-dispensing device 20 to the surface of the stencil film 18 and the squeegee 24 wipes across the stencil pattern 36 to force encapsulant 22 through the openings 39 and onto the inkjet printhead body 44. After the selective application of the encapsulant to the inkjet printhead body 44, the inkjet printhead body is removed from contact with the stencil film 18.

The stencil film is conveyed around intermediate roller 14 and to cleaning device 26 where residual encapsulant on the stencil film 18 is removed by cleaning blade 28. Residual encapsulant removed by the cleaning device is captured in waste box 32. In accordance with the stencil printing system shown in FIG. 1, the clean stencil film 18 is then rewound on rewind roll 16.

The process is then repeated with the next inkjet printhead body, which may be of the same type as the first inkjet printhead body processed or of a different type thereby requiring a different stencil pattern. In this manner, various inkjet printhead body types can be processed continuously without requiring changeover of the entire printing system to install different stencil patterns.

The stencil printing system shown in FIG. 3 operates in a similar manner except the stencil film 18 is mounted in a continuous loop around first and second roller 40 and 42. Rollers 40 and 42 can be driven rollers to index the stencil film 18 in either direction. Furthermore, the system in FIG. 3 illustrates the use of a cleaning bath 46 and solvent removal system 48 disposed downstream of the cleaning device 26. The stencil film with residual encapsulant progresses through the solvent cleaning bath 46 to remove any residual encapsulant from both sides of the stencil film 18 as well as the openings 39. Solvents useful in solvent bath 46 are not particularly limited and can include any of those typically used for cleaning encapsulant material. The solvent removal system 48 may include any of a variety of systems for removing solvent or evaporating solvent from the stencil film 18. For example, the solvent removal system 48 may include a cleaning or drying sheet which contacts the stencil film 18 to remove any residual solvent or encapsulant. Alternatively, the solvent removal system 48 may include a dryer unit which evaporates solvent by passing air over and/or around the stencil film 18. The air may be at ambient or elevated temperatures.

Of course, any of the elements of the invention can be combined in various ways as required by the specific operation of the printhead manufacturing process. For example, the cleaning bath 46 and solvent removal system 48 may be combined in a single unit. Likewise, the encapsulant-dispensing device 20 and the squeegee 24 may be components of a single device.

The optical sensor 34 may be used to index the stencil film 18 and verify the position and product reference of the stencil in the system. The sensor 34 may be configured to identify corresponding features 37 designed into the stencil film 18. Such features include, but are not limited to, features specifically designed for various applications. Examples of such features include:

1. Different spacing or positions to allow use of the stencil for different printhead designs.
2. Timing shapes that can be used to optimize the index speed or adjust the cleaning blade pressure by measuring system drag.
3. Multiple shapes to correspond with multiple sensors to provide separate indexing and positioning feedback.

The ability of the stencil printing system to automatically detect the printhead type and correct stencil allows for production flexibility. For example, the same machine can be used to process multiple manufacturing lines. The same continuous stencil layout can be produced for used on several machines or switched among several machines to reduce downtime.

The encapsulant material 22 is typically characterized by adhesion to the polymeric materials used in the construction of various components of the inkjet print body 44. Examples of such polymeric materials include, but are not limited to, polyimide materials such as those commercially available from E.I. DuPont de Nemours & Co. under the trademark KAPTON and from Ube under the trademark UPILEX.

Preferably, the encapsulant material 22 is resistant to ink and is capable of adequately protecting sensitive areas of the inkjet printhead body 44. The encapsulant material 22 in accordance with certain embodiments of the invention has a glass transition temperature of greater than or equal to about 60° C. Specific examples of adhesives useful herein include one part thermal cure epoxy adhesives such as Epibond 89713 from Huntsman Advanced Chemicals, Inc. and Loctite 221521 and Loctite 256579 both available from Henkel Technologies Corporation. Adhesives not specifically set out herein may also be used.

The stencil film 18 can be made of various materials. Particularly useful examples include, but are not limited to plastics and stainless steels. Specific examples of useful plastics include but are not limited to, polyimides and fluoropolymer-coated polyimides. Kapton is a particularly useful material for forming the stencil film. The stencil thickness typically varies from about 0.001 to about 0.015 inches, more particularly from about 0.003 to about 0.009 inches.

Various materials can be used to produce the squeegee used in accordance with the present invention. Examples of useful materials include, but are not limited to, polyethylene, polyurethane, stainless steel and polytetrafluoroethylene (available under the trademark TEFLON® from E.I. DuPont de Nemours & Co.). The squeegee blades typically have a hardness of between about 0 to about 70 durometer, more typically about 50 durometer, on a Shore D scale or a Shore A equivalent. The squeegee contact angle with the stencil typically ranges from about 35 to 75 degrees. The target condition is about 50 degrees.

Stencil printing offers a number of advantages over dispensing systems. The ability to apply a more consistent layer of encapsulant at precise locations increases yields and productivity. Taping the printhead is more easily accomplished with stencil printed encapsulant due to its uniformity in location and height. Maintenance of the printhead between uses is improved with stencil printed encapsulant. The wiper which runs across the printhead cleans it more thoroughly with the lower, more uniform encapsulant. Multiple locations may be stencil printed in a single operation thereby reducing production costs. For example, a stencil can be used to seal the tab circuit to the cartridge at the same time it provides encapsulant over the electrical connections. The encapsulant can be provided in a number of configurations. Encapsulant can be stencil printed in controlled, intricate designs, and in larger areas.

The progressive stencil printing system described herein can provide a method for stencil printing which reduces or eliminates defects associated with entrapped air in the adhesive. Some stencil printing operations can result in entrapped air in the adhesive during the printing process. The entrapped air can create defects in the final product. Certain aspects of the present invention include the use of a new stencil position for each part to be printed. Accordingly, in accordance with these aspects of the present invention, when the stencil is advanced the pre-existing material on that portion of the stencil is also removed from the process. The use of fresh material reduces problems associated with entrapped air. Furthermore, the use of fresh material also eliminates the effects of shear history on the material properties. Materials with slow relaxation or recovery times can be successfully used in stencil printing systems that print each stencil pattern using fresh material. The ability to print using materials with slow relaxation or recovery times can be advantageous because these types of materials tend to provide improved dimensional stability. Although the use of fresh material and a new stencil for every printed pattern provides advantages relative to conventional systems, the present invention is not limited to systems utilizing fresh material or a new stencil. These systems represent particular aspects of the present invention. Other aspects of the invention may involve the use of a single stencil for multiple printed patterns and the material may not be completely removed between printings.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. A stencil printing system for applying encapsulant onto an inkjet printhead body comprising:

a stencil film comprising a first stencil pattern and a second stencil pattern, each of the stencil patterns corresponding to a pattern of encapsulant adhesive to be applied onto an inkjet printhead body;

a first drive device coupled to the stencil film to move the film along a given path;

an encapsulant-dispensing device for applying encapsulant to a printhead body through one of the first and second stencils; and a cleaning device positioned downstream of the encapsulant dispensing device for removing residual encapsulant from said film, wherein the encapsulant-dispensing device applies encapsulant through the first stencil onto a first printhead body and the encapsulant-dispensing device applies encapsulant through the second stencil onto a second printhead body.

2. The stencil printing system of claim 1 wherein said cleaning device comprises a cleaning blade that contacts the film at an angle to remove residual encapsulant from the film.

3. A stencil printing system for applying encapsulant onto an inkjet printhead body comprising:

a stencil film comprising a first stencil pattern and a second stencil pattern, each of the stencil patterns corresponding to a pattern of encapsulant adhesive to be applied onto an inkjet printhead body;

a first drive device coupled to the stencil film to move the film along a given path;

an encapsulant-dispensing device for applying encapsulant to a printhead body through one of the first and second stencils; and an optical sensor, the optical sensor capable of detecting features on the stencil indicative of a parameter selected from the group consisting of location, timing, identity and combinations thereof wherein the encapsulant-dispensing device applies encapsulant through the first stencil onto a first printhead body and the encapsulant-dispensing device applies encapsulant through the second stencil onto a second printhead body.

4. A stencil printing system for applying encapsulant onto an inkjet printhead body comprising:

a stencil film comprising a first stencil pattern and a second stencil pattern, each of the stencil patterns corresponding to a pattern of encapsulant adhesive to be applied onto an inkjet printhead body;

a first drive device coupled to the stencil film to move the film along a given path;

an encapsulant-dispensing device for applying encapsulant to a printhead body through one of the first and second stencils; and a means for identifying a type of printhead body to be printed wherein the encapsulant-dispensing device applies encapsulant through the first stencil onto a first printhead body and the encapsulant-dispensing device applies encapsulant through the second stencil onto a second printhead body.

5. The stencil printing system of claim 4 wherein said means comprises data input to a controller by an operator.

6. The stencil printing system of claim 4 wherein said means comprises a controller including automated means for identifying a type of printhead body.

7. The stencil printing system of claim 6 wherein said automated means comprises an image-capture device or scanner.

8. A stencil printing system for applying encapsulant onto an inkjet printhead body comprising:

a stencil film comprising a first stencil pattern and a second stencil pattern, each of the stencil patterns corresponding to a pattern of encapsulant adhesive to be applied onto an inkjet printhead body;

a first drive device coupled to the stencil film to move the film along a given path;

an encapsulant-dispensing device for applying encapsulant to a printhead body through one of the first and second stencils; and a cleaning bath disposed downstream of said encapsulant dispensing device for removing residual encapsulant from said stencil, said cleaning bath containing a solvent, wherein the encapsulant-dispensing device applies encapsulant through the first stencil onto a first printhead body and the encapsulant-dispensing device applies encapsulant through the second stencil onto a second printhead body.

9. The stencil printing system of claim 8 wherein said cleaning bath is an ultrasonic solvent bath.

10. A stencil printing system for applying encapsulant onto an inkjet printhead body comprising:

a stencil film comprising a first stencil pattern and a second stencil pattern, each of the stencil patterns corresponding to a pattern of encapsulant adhesive to be applied onto an inkjet printhead body, a first drive device coupled to the stencil film to move the film along a given path;

an encapsulant-dispensing device for applying encapsulant to a printhead body through one of the first and second stencils, and at least one of an optical sensor capable of detecting features on the stencil indicative of a parameter selected from the group consisting of location, timing, identity and combinations thereof, and a means for identifying a type of printhead body to be printed wherein the encapsulant-dispensing device applies encapsulant through the first stencil onto a first printhead body and the encapsulant-dispensing device applies encapsulant through the second stencil onto a second printhead body and wherein each of the first and second printhead bodies includes a nozzle plate.

11. A stencil printing system for applying encapsulant onto an inkjet printhead body comprising:

a stencil film comprising a first stencil pattern and a second stencil pattern, each of the stencil patterns corresponding to a pattern of encapsulant adhesive to be applied onto an inkjet printhead body, a first drive device coupled to the stencil film to move the film along a given path;

an encapsulant-dispensing device for applying encapsulant to a printhead body through one of the first and second stencils, and at least one of a cleaning device positioned downstream of the encapsulant dispensing device for removing residual encapsulant from said film and a cleaning bath disposed downstream of said encapsulant dispensing device for removing residual encapsulant from said stencil, said cleaning bath containing a solvent wherein the encapsulant-dispensing device applies encapsulant through the first stencil onto a first printhead body and the encapsulant-dispensing device applies encapsulant through the second stencil onto a second printhead body and wherein each of the first and second printhead bodies includes a nozzle plate.

* * * * *